US008955440B2

(12) United States Patent
Schnabel et al.

(10) Patent No.: US 8,955,440 B2
(45) Date of Patent: Feb. 17, 2015

(54) METHOD FOR CONTROLLING A PRINTING OPERATION

(75) Inventors: Holger Schnabel, Veitshoechheim (DE); Stephan Schultze, Lohr-Wombach (DE)

(73) Assignee: Robert Bosch GmbH, Stuttgart (DE)

( * ) Notice: Subject to any disclaimer, the term of this patent is extended or adjusted under 35 U.S.C. 154(b) by 205 days.

(21) Appl. No.: 13/419,034

(22) Filed: Mar. 13, 2012

(65) Prior Publication Data

US 2012/0234192 A1 Sep. 20, 2012

(30) Foreign Application Priority Data

Mar. 16, 2011 (DE) ..... 10 2011 014 073

(51) Int. Cl.

| | |
|---|---|
| ***B41F 1/34*** | (2006.01) |
| ***B41F 33/00*** | (2006.01) |
| ***B41F 33/14*** | (2006.01) |
| ***B41F 21/00*** | (2006.01) |

(52) U.S. Cl.

CPC ..... *B41F 33/00* (2013.01); *B41F 33/14* (2013.01); *B41F 21/00* (2013.01)

USPC ..... 101/486; 101/483; 101/481

(58) Field of Classification Search

CPC ..... B41F 33/0081; G03G 2215/0164; B41P 2233/51; B41P 2233/52

See application file for complete search history.

(56) References Cited

U.S. PATENT DOCUMENTS

| | | | | |
|---|---|---|---|---|
| 4,528,630 | A * | 7/1985 | Sargent | 700/125 |
| 6,256,474 | B1 * | 7/2001 | Gibisch et al. | 399/384 |
| 7,040,232 | B2 * | 5/2006 | Van Holten et al. | 101/484 |
| 7,515,267 | B2 * | 4/2009 | Ehbets et al. | 356/416 |
| 7,650,019 | B2 * | 1/2010 | Turke et al. | 382/112 |
| 2009/0123206 | A1 * | 5/2009 | Schnabel et al. | 400/76 |
| 2010/0058944 | A1 * | 3/2010 | Kaiser et al. | 101/177 |

FOREIGN PATENT DOCUMENTS

| | | | |
|---|---|---|---|
| DE | 10 2004 021 599 | A1 | 12/2005 |
| DE | 10 2008 049 908 | A1 | 4/2010 |

* cited by examiner

*Primary Examiner* — Daniel J Colilla
*Assistant Examiner* — John M Royston
(74) *Attorney, Agent, or Firm* — Maginot, Moore & Beck LLP

(57) ABSTRACT

A method for controlling a printing operation includes detecting at least one position and/or an extent of a register mark located on a printing material by means of a register mark sensor, and using the detected at least one position and/or the extent of the register mark for register control. The method further includes acquiring at least one item of color information by means of the same register mark sensor during the printing operation, carrying out color monitoring with at least the at least one item of color information, and determining a color deviation with respect to a reference value. Furthermore, the method includes defining a threshold value for the color deviation, and outputting a warning and/or automatically making a change from good to poor products when the threshold value for the color deviation is exceeded.

10 Claims, 1 Drawing Sheet

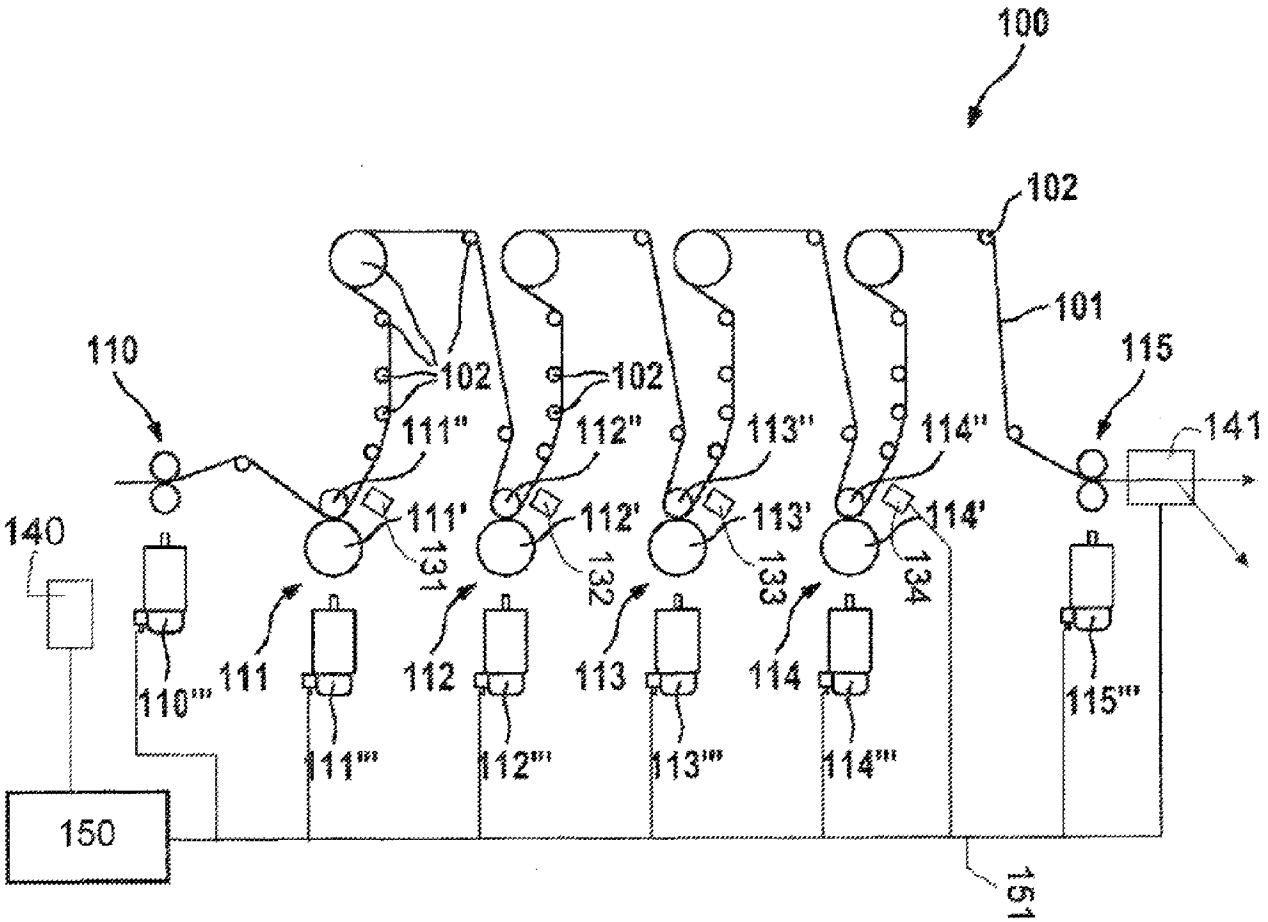
100
102
101
115
141
115'''
151
114''
114'
134
114'''
114
113''
113'
133
113'''
113
102
112''
112'
132
112'''
112
102
111''
111'
131
111'''
111
110'''
110
140
150

METHOD FOR CONTROLLING A PRINTING OPERATION

This application claims priority under 35 U.S.C. §119 to German patent application no. DE 10 2011 014 073.5, filed Mar. 16, 2011 in Germany, the disclosure of which is incorporated herein by reference in its entirety.

BACKGROUND

The present disclosure relates to a method for controlling a printing operation, a computing unit for carrying out the method, a register mark sensor, and a control system for a printing press.

During multicolor printing, for example in rotary printing presses, the application of the individual color separations, in particular for cyan, magenta, yellow and black, takes place in successive printing units. The printing material is provided as roll material and led endlessly through the print unit. Critical for the printing quality achieved is that the printed images of the individual colors lie exactly above one another. The superimposition of the printed images is designated register. For the purpose of mutual alignment of the individual printing units, in addition to the actual printed image, register marks, for example in the form of register crosses, triangles and so on, are printed on by each printing unit. By using these marks, an offset between the individual printed images can be detected online by an optical measuring system. In rotary printing systems, this measuring system is generally a constituent part of a control system, what is known as register control. The register control intervenes in the printing process via suitable actuating elements and compensates for register deviations recognized by the optical measuring system (detector; register mark sensor). In particular, the actuating elements are able to change the web length of the printing material between successive printing units in such a way that the printed images of successive print units lie above one another. Detectors used are contrast sensors, color sensors or cameras, which typically operate by reflection. The material web is illuminated constantly or in a pulsed manner by using a suitable light source (white or colored light), and the reflected light is detected by the sensor and evaluated.

Before any sensing by contrast or color sensors, a teaching operation is normally carried out, in which a signal threshold is learned, with the aid of which a distinction is drawn between "mark" and "no mark". The time of that scanning in which the signal to be evaluated exceeds or falls below the signal threshold is taken as the time of the contrast change. DE 10 2008 049 908 A1 discloses a color-sensitive register mark sensor which, for the purpose of improved recognition of the register mark position, carries out an evaluation of at least two items of color information. It is also possible for low-contrast register marks to be recognized reliably. Color control is not treated.

In addition, color control or color checking is carried out during printing. Nowadays, this is increasingly carried out as in-line color control, as it is known, during the printing operation, color measuring areas (color control strips) being detected by means of specific color sensors. In-line color control is described, for example, in DE 10 2004 021 599 A1.

The disadvantage with the prior art is that relatively many and also complicated detectors are needed for the register control and the color control. Furthermore, in addition to the register marks, the color measuring areas also have to be printed on, which increases the requirement for printing ink, which in specific cases is relatively expensive.

There is therefore a need to devise an improved method for controlling a printing operation which requires less effort.

SUMMARY

According to the disclosure, a method for controlling a printing operation is proposed. The disclosure also includes a computing unit for carrying out the method, a register mark sensor and a control system for a printing press. Advantageous refinements are the subject matter of the following disclosure.

The disclosure makes use of a color-sensitive register mark sensor (intensity sensor) in order therewith not only to detect register mark positions or extents but also to acquire color information and in each case to use the latter for the appropriate control or monitoring. As a result, the disclosure creates the possibility of simultaneous control and/or measurement of the position/extent (register control) and color by using a single detector. The effort and the costs for color and register control can be reduced considerably since, in particular, the measurement of the color information is not carried out by expensive camera systems but by less expensive mark sensors. In this connection, it is also to be mentioned that the color resolution of color cameras is generally poorer than that of mark stream sensors and that, for high color resolution in the case of cameras, a multiplicity of specific filters between camera chip and printed material have to be changed successively, which leads to a long measurement time.

Color monitoring is carried out in order to be able to react automatically in the event of an excessively large color deviation. As a result of using register mark sensors, the color sensitivity in the printing press can be increased such that a deviation or a trend can already be recognized early. As a result of the early warning, rejects can be avoided. If rejects nevertheless occur, they can be separated out automatically. In addition, color control can be provided, in this case the color monitoring helping to compensate for shortcomings in the color control.

It is recommended to acquire the at least one item of color information likewise on a register mark, so that additional color measuring areas can be left out. This reduces the effort on printing and the requirement for ink and therefore also the costs. In this case, the acquisition is carried out exclusively on register marks. However, alternatively or additionally, provision can be made to continue to acquire the color information on specific color measuring areas.

During the determination of the colors and the evaluation thereof, various color spaces can be used. For example, CIE-L*a*b*, CIE-L*u*v*, DIN99, RGB, CIE XYZ, CIE xyY may be mentioned for this purpose. The CIE-L*a*b* color space is particularly suitable, since a Euclidian distance determined there matches the human color perception very well.

Expediently, a polarization filter is used during the acquisition of the color information, in order to reduce interference. Densities measured in-line are wet values, which depend on the combination comprising printing ink, paper, damping solution. The mark stream sensor is generally located relatively close after a printing unit. As a result, the moisture content of the ink applied can differ from the learned reference color information. Furthermore, the moisture content of the register marks can also differ at different material web speeds.

According to a further embodiment of the disclosure, provision can be made to detect a tonal value change. Depending on printing ink and printing material, the color is absorbed differently. This means that, for example, as a result of a greater absorption capacity of a paper, a printed dot appears to be enlarged (tonal value gain). In the printed image, this manifests itself as a more intense color impression. This tonal value behavior can be calibrated with the aid of particular color measuring areas of different ink density (e.g. 10%, 20%, . . . , 100% ink density). Although the sensor detects the same color each time (for example in the xyY color space), the lightness information (color saturation) will be different in each case. By using the measuring areas, the color absorption behavior can therefore likewise be measured as well by the sensor. This characteristic curve can be used to characterize the printing ink in conjunction with the mechanism of the inking zone screws and the substrate in their overall transfer behavior.

Preferably, a first threshold value for a color deviation from a reference color is defined. If this first threshold value is exceeded, a warning signal is expediently given to the operator. The first threshold value should be predefined such that, when it is exceeded, rejects are not yet produced. Thus, the operator has the possibility of checking the color in good time and, if necessary, intervening manually in the color composition. In addition, a second threshold value can be provided at which, when exceeded, a change is automatically made from good to poor products. This can be done, for example, via a rejects diverter, as it is known, which then removes the poor products out of the production stream.

In a further preferred refinement, a trend display of the changes in the color information can be provided. Thus, the long-term development of the color information and changes in the composition of the color can be recognized particularly simply. A similar visualization can be provided in order to indicate the effects of the control. For example, the quantity of solvent added and the resultant change in the color information (gradient determination) are recorded. From this information, the operator is able to accumulate manual empirical values. Furthermore, these effects can be learned automatically by the control system.

If color information is measured from register marks, the results depend on the background color. In particular, the same printing ink on different printing materials (e.g. paper grades) results in different colors. If, then, not only the colors of the printing marks but also the color of the background are measured, the color control is able not only to control to an absolute color but to a fixed color locus in relation to the respective background color. Likewise, presetting values of color control setting values, which for example have been determined from recipes of preceding print jobs, can be predefined in a manner changed by using the background color of the substrate of the old print job and the current substrate, in such a way that a changed background color does not lead to a different printed color.

A computing unit according to the disclosure, for example a control device of a printing press, is set up, in particular by programming, so as to carry out a method according to the disclosure.

The implementation of the disclosure in the form of software is also advantageous, since this permits particularly low costs, in particular if an executing computing unit is also used for further tasks and is therefore present in any case. Suitable data storage media for providing the computer program are in particular floppy disks, hard drives, flash memories, EEPROMs, CD-ROMs, DVDs and many more. A download of a program via computer networks (Internet, Intranet and so on) is also possible.

Further advantages and refinements of the disclosure can be gathered from the description and the appended drawing.

It goes without saying that the features mentioned above and still to be explained below can be used not only in the respectively specified combination but also in other combinations or on their own without departing from the context of the present disclosure.

The disclosure is illustrated schematically in the drawing by using an exemplary embodiment and will be described extensively below with reference to the drawing.

BRIEF DESCRIPTION OF THE DRAWING

The FIGURE shows, schematically, an extract from a printing press having a control system according to the disclosure, in which the method according to the disclosure is implemented.

DETAILED DESCRIPTION

In the FIGURE, a processing machine configured as a printing press is designated overall by 100. A printing material, for example paper 101, is fed to the machine via an infeed 110. The paper 101 is led through processing devices formed as printing units 111, 112, 113, 114, printed and output again by an outfeed 115. The infeed, outfeed and printing units are arranged such that they can be positioned, in particular the cylinder or angle can be corrected. As products, the printing press outputs printed images on the paper 101, which are composed of the part images applied by the printing units 111, 112, 113, 114.

The printing units 111 to 114 each have an impression cylinder 111' to 114', against which in each case a press roll 111" to 114" (mating printing point) is set with high pressure. The impression cylinders are driven individually and independently. The associated drives 111''' to 114''' are illustrated schematically. The press rolls are formed such that they can rotate freely. The printing units 111 to 114, in each case together with the paper 101 passing through, form a unit (clamping point) connected by a force fit. The drives of the individual units are connected via a data link 151 to a computing unit (e.g. a controller) 150. Furthermore, between the printing units there are a plurality of sensors 131, 132, 133, 134 for detecting register marks, which are likewise connected to the controller 150. For reasons of clarity, only one of the sensors 134 connected to the controller is shown.

In the web sections between the individual printing units 111 to 114, the paper 101 is led over rollers, not specifically explained, of which some are designated 102. For reasons of clarity, not all of the rollers are provided with reference symbols 102. These can be, in particular, deflection rollers, drying, cooling or trimming devices and so on.

It will be described below how, in the printing press illustrated, register control, for example longitudinal and/or lateral register control, is carried out. For a register-maintaining print, the part images printed by the printing units 111 to 114 must be located in the correct position one above another. In order to determine the processing position (printing position) of the part images, what is known as a register mark is printed with each part image. These register marks are detected by the detectors 131, 132, 133, 134 formed as mark sensors.

One possible way of characterizing known register methods lies in considering the reference variables which are used for the determination of the deviation of the positions of part images from their reference positions. By means of this differentiation possibility, it is possible to draw distinctions between web/web methods and web/cylinder methods.

In a web/cylinder method, as the product web passe's, the position of a predetermined register mark and the position of an impression cylinder (for example determined by using a rotary encoder) are compared. In a web/web method, as the product web passes, the positions of a predetermined register mark and a further register mark are compared. In both cases, a respective register deviation can be calculated. The register deviations determined are used for positioning the printing units, on the one hand of the measured one and on the other hand of the one which has printed the further register mark.

If the predetermined register mark is the mark respectively applied by the preceding impression cylinder, one speaks of precursor color control. If the predetermined register mark is always the same register mark (which is preferably applied by the first printing unit), one speaks of standard color control.

According to a refinement of the disclosure, the sensors 131-134 are used not only to detect the longitudinal and/or lateral register position of the printing units 114 but also to acquire color information. Each of the sensors 131-134 expediently also acquires the color information from the register mark assigned thereto. It is likewise possible for only one sensor to be provided after the last printing unit, i.e. only the sensor 134, which then detects all the marks. The color information is preferably the color density or a color deviation from a reference color previously defined or learned during teaching. By means of this embodiment, additional color sensors can be saved. In order to improve the acquisition of the color information, a 45°/0° geometry or a 0°/45° geometry (irradiation angle/detection angle) is expediently used.

Evaluation electronics provided in the sensor or connected to the latter evaluate both the mark lengths, for example the mark spacings, and also the color information and pass this information on to one or more control systems, here the controller 150. The controller 150 is preferably set up by programming, according to a preferred embodiment of the disclosure, and executes both the control algorithms for the register control and for the color monitoring and, if appropriate, color control. Thus, automated control of the mark position and printing unit color can be carried out. Furthermore, appropriate warnings can be output. In a refinement of the disclosure, the sensor itself comprises evaluation electronics (what is known as a Smart Sensor) and is connected directly to the controller 150 via the data link 151, for example a field bus link. The sensor transmits to the controller a first signal for the register control and a second signal for the color monitoring and preferably also color control.

In order to be able to detect a color change in the printing process, a reference is expediently defined. To this end, three preferred alternatives will be described below:

It is possible to predefine the reference color by means of a teaching operation. Before the printing, as a rule a teaching operation is carried out in order to teach the sensor the register marks in the expected range. During the teaching operation, for example, different threshold values for the subsequent measurement are calculated. The expected range is either predefined manually by the user or determined automatically by the sensor (e.g. by barcode search). The teaching operation is started exactly when the desired color composition is present, i.e. the sensor determines threshold values for the position measurement and, at the same time or subsequently, the corresponding color values from the stream of register marks and from additional color measuring areas. The corresponding color values can be read and can be stored, for example in a recipe. The color values determined in this way are adopted as a reference value for the measurement.

Alternatively, color density and reference value can be taken from an original or from the prepress stage. Here, even before the actual printing operation, by using the printing original (e.g. reference colors or a first printed "good product"), the correct colors are learned by the sensor by means of a teaching operation. Here, the colors can be learned either from the register mark stream or from a print control strip having different color areas. Provision is expediently made to measure a plurality of color densities of a color in different areas, in order to permit the sensor to make a direct assignment to different color densities. The values learned are then used in the printing process for comparison with the register marks then printed. Alternatively, the colors of the measured marks or color measuring areas from a prepress stage (in digital form) can be transmitted to the color control.

Finally, provision can also be made to predefine the reference values manually from a recipe. The reference values (for example determined once as explained above) are loaded into the sensor before starting printing. It is thus ensured that the color compositions of the same print jobs agree completely even after chronological interruptions. The sensor acquires the color information in the register mark stream or the color measuring areas and compares this with the recipe values. Thus, as printing starts, color control and register control can be carried out.

During the printing operation (so to speak in the continuous process), the mark sensor detects the register mark(s) applied. It evaluates the results of the mark position(s) (for example at a zero pulse) and determines the color information. The determined color information is compared with the reference values. The color difference can be calculated, for example as a Euclidean distance (distance between two color loci), the following being true for the CIELab color space:

$$\Delta E_{p,v}=\sqrt{((L_p^*-L_v^*)^2+(a_p^*-a_v^*)^2+(b_p^*-b_v^*)^2)}$$

Furthermore, $\Delta E_{94}$ or $\Delta E_{00}$ can also be calculated as color deviation. The calculated color deviations and positions are expediently transmitted via an Ethernet bus or via a real-time interface (e.g. Sercos III) to the controller 150, where the appropriate control algorithms for the position and color control run.

The color and position information determined from the register marks in the sense of the disclosure is expediently transmitted to a control system. On the control system, in a preferred refinement, both the control algorithms for the position control and also for the color control are executed. The controller can carry out freely programmable control algorithms in its logic part, in order to derive the appropriate position adjustment therefrom. For the color control, further interfaces are created, with which the controller can intervene in the color control. For instance, the supply of water or solvent can be carried out under automatic control if the color consistency has changed and this has been detected from the register mark stream by means of the measurement.

Furthermore, the controller 150 is programmed to carry out a threshold value comparison. To this end, a first and a second threshold value for the color deviation are predefined. If the first threshold value is exceeded, a warning signal is given to the operator via a warning device 140, for example a monitor and/or a warning lamp. The first threshold value is predefined such that, when it is exceeded, rejects are not yet being produced. The operator thus has the possibility of checking the color in good time and, if necessary, intervening manually in the color composition. This is provided for cases in which the color control is not sufficient to control out deviations. If the second threshold value is exceeded, a rejects diverter 140 is switched over automatically in order to remove poor products from the production stream.

What is claimed is:

1. A method for controlling a printing operation of a printing device including a plurality of printing units, the printing device outputting printed images which are composed of part images applied by the plurality of printing units, comprising:

detecting at least one position and/or an extent of a first register mark located on a printing material in relation to a second register mark by means of a register mark sensor, the first register mark being applied to the print material along with a first part image of a printed image by a first printing unit and being of a first color, the second register mark being applied to the printing material along with a second part image of the printed image by a second printing unit and being of a second color;

using the detected at least one position and/or the extent of the first register mark in relation to the second register mark for register control of the first and/or the second printing unit;

acquiring at least one item of color information from the first register mark and at least one item of color information from the second register mark by means of the same register mark sensor during the printing operation;

carrying out color monitoring with at least the at least one item of color information from the first register mark and at least one item of color information from the second register mark;

determining a color deviation of the at least one item of color information from the first register mark with respect to a first reference value;

defining a threshold value for the color deviation; and outputting a warning and/or automatically making a change from good to poor products when the threshold value for the color deviation is exceeded.

2. The method according to claim 1, further comprising: using the at least one item of color information to carry out in-line color control of the first printing unit.

3. The method according to claim 1, wherein a color density and/or a color deviation from a reference value is determined by the register mark sensor on the basis of the at least one item of color information.

4. The method according to claim 3, wherein the reference value is determined from a teaching operation, an original from the pre-press stage, or a recipe.

5. The method according to claim 1, wherein a polarization filter is used during the acquisition of the color information.

6. The method according to claim 1, wherein a computing unit carries out the combined and automatic control of the register and of the color.

7. The method according to claim 1, further comprising: providing a trend display representing the color deviation.

8. The method according to claim 1, further comprising: taking into account and compensating for a background color during the color measurement.

9. The method according to claim 1, further comprising: detecting a tonal value change.

10. The method according to claim 1, wherein a computing unit is configured to (i) carry out the color monitoring, (ii) determine the color deviation, (iii) define the threshold value, and (iv) output the warning and/or automatically make the change.

* * * * *